US009502814B2

(12) United States Patent
Furukawa

(10) Patent No.: US 9,502,814 B2
(45) Date of Patent: Nov. 22, 2016

(54) CONNECTOR COVER AND CONNECTOR CONNECTING APPARATUS

(75) Inventor: Tatsuhiko Furukawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 14/399,070

(22) PCT Filed: Jul. 20, 2012

(86) PCT No.: PCT/JP2012/068468

§ 371 (c)(1),
(2), (4) Date: Nov. 5, 2014

(87) PCT Pub. No.: WO2014/013612

PCT Pub. Date: Jan. 23, 2014

(65) Prior Publication Data

US 2015/0126082 A1 May 7, 2015

(51) Int. Cl.

*H01R 13/502* (2006.01)
*H01R 13/518* (2006.01)
*H01R 13/621* (2006.01)

(52) U.S. Cl.

CPC ..... *H01R 13/518* (2013.01); *H01R 13/6215* (2013.01)

(58) Field of Classification Search

CPC ..... H01R 13/518; H01R 2103/00; H01R 13/514; H01R 13/506
USPC ..... 439/540.1, 598, 599, 701, 903
See application file for complete search history.

(56) References Cited

U.S. PATENT DOCUMENTS 5,312,268 A * 5/1994 Sumida ..... H01R 13/631 439/364
5,314,357 A * 5/1994 Weidler ..... H01R 13/518 439/680
5,398,295 A * 3/1995 Chang ..... G02B 6/3879 385/136
5,679,028 A 10/1997 Yagi et al.
6,010,351 A 1/2000 Kuboto (Continued)

FOREIGN PATENT DOCUMENTS

JP 08-007972 A 1/1996
JP 10-134891 A 5/1998

(Continued)

OTHER PUBLICATIONS

Communication dated Oct. 31, 2014, issued by the Taiwanese Patent Office in counterpart Application No. 102100203.

(Continued)

*Primary Examiner* — Thanh Tam Le
(74) *Attorney, Agent, or Firm* — Sughrue Mion, PLLC

(57) ABSTRACT

A connector cover holds altogether a plurality of insertion connectors, the insertion connectors being provided at corresponding ends of cables and inserted into reception connectors. The connector cover includes a cover part in which a plurality of holding openings that hold the insertion connectors with ends thereof being exposed are formed so that the insertion connectors can be inserted into the reception connectors. The cover part can be divided along a dividing surface including the holding openings. The cover part is formed with a lock-lever pressing part that presses a lock lever of corresponding one of the insertion connectors held by the holding openings to fix the insertion connectors in an unlocked state for each of the holding openings.

7 Claims, 5 Drawing Sheets

(56) References Cited

U.S. PATENT DOCUMENTS

| | | | | |
|---|---|---|---|---|
| 6,077,127 | A * | 6/2000 | Wu | H01R 13/514 439/701 |
| 6,109,978 | A * | 8/2000 | Stellman | H01R 13/514 439/484 |
| 6,210,216 | B1 * | 4/2001 | Tso-Chin | H01R 13/748 439/545 |
| 6,305,986 | B1 * | 10/2001 | Hwang | H01R 13/6485 439/358 |
| 6,345,996 | B2 * | 2/2002 | Saito | 439/159 |
| 6,666,715 | B2 | 12/2003 | Fujita et al. | |
| 6,857,900 | B2 * | 2/2005 | Kleeberger | H01R 13/6215 385/76 |
| 7,278,879 | B2 * | 10/2007 | Kim | H01R 13/518 439/540.1 |
| 7,367,832 | B2 | 5/2008 | Muhs et al. | |
| 8,382,515 | B2 * | 2/2013 | Caveney | H01R 13/518 439/532 |
| 8,430,692 | B2 * | 4/2013 | Peng | H01R 13/518 439/607.46 |
| 8,523,607 | B2 * | 9/2013 | Sakurai | H01R 43/24 439/540.1 |
| 2007/0105432 | A1 | 5/2007 | Muhs et al. | |

FOREIGN PATENT DOCUMENTS

| | | | |
|---|---|---|---|
| JP | 10-191534 | A | 7/1998 |
| JP | 2000-182709 | A | 6/2000 |
| JP | 2001-244033 | A | 9/2001 |
| JP | 2002-124341 | A | 4/2002 |
| JP | 2003-036917 | A | 2/2003 |
| JP | 2006-252952 | A | 9/2006 |
| JP | 2008-066121 | A | 3/2008 |
| JP | 2008-130511 | A | 6/2008 |
| JP | 2008-226609 | A | 9/2008 |
| JP | 2010-103029 | A | 5/2010 |
| JP | 2010-238503 | A | 10/2010 |
| JP | 2011-228154 | A | 11/2011 |
| TW | M408844 | | 8/2011 |
| TW | I407645 | B | 9/2013 |
| TW | I407645 | B | 9/2013 |

OTHER PUBLICATIONS

International Search Report of PCT/JP2012/068468 dated Sep. 25, 2012 [PCT/ISA/210].

Communication dated Feb. 26, 2016, from the State Intellectual Property Office of People's Republic of China in counterpart application No. 201280074812.X.

Communication dated Aug. 1, 2016, issued by the State Intellectual Property Office of the P.R.C. in corresponding Chinese Application No. 201280074812.X.

* cited by examiner

CONNECTOR COVER AND CONNECTOR CONNECTING APPARATUS

CROSS REFERENCE TO RELATED APPLICATIONS

This application is a National Stage of International Application No. PCT/JP2012/068468, filed Jul. 20, 2012, the contents of which are incorporated herein by reference in its entirety.

FIELD

The present invention relates to a connector cover that holds a plurality of cable connectors altogether and a connector connecting apparatus that includes the connector cover.

BACKGROUND

A connector connecting apparatus having a plurality of reception connectors into which insertion connectors (cable connectors) provided at ends of cables are inserted has been conventionally used. For example, in a control device serving as a connector connecting apparatus in which a control substrate controlling an industrial robot is provided within a casing, a plurality of reception connectors mounted in an aligned manner on the control substrate are exposed to outside of the casing.

The insertion connectors are inserted into these reception connectors, respectively. Further, when the insertion connectors are individually inserted into and removed from the reception connectors, the number of steps is increased and thus the operation becomes complicated. When a plurality of connectors of the same shape are used, there may be a case where a correspondence between the insertion connectors and the reception connectors cannot be recognized when the insertion connectors have been once removed. Therefore, for example, Patent Literature 1 discloses a cover in which a plurality of insertion connectors are held in an aligned manner to enable the insertion connectors to be inserted and removed altogether and to prevent a correspondence between the insertion connectors and reception connectors from becoming unrecognized.

CITATION LIST

Patent Literature

Patent Literature 1: Japanese Patent Application Laid-open No. 2006-252952

SUMMARY

Technical Problem

A general insertion connector includes a fall-prevention lock lever for preventing the insertion connector from accidentally falling off a reception connector, and the insertion connector needs to be removed while the fall-prevention lock lever is being pressed down. The cover disclosed in Patent Literature 1 includes a connector removing unit for pressing down altogether the fall-prevention lock levers of the insertion connectors held in an aligned manner.

However, postures of the insertion connectors held by the cover are determined by postures of the reception connectors exposed from a casing, and the insertion connectors cannot be always held in postures where the fall-prevention lock levers are oriented in a direction in which the fall-prevention lock levers can be pressed down from the connector removing unit. Therefore, the cover disclosed in Patent Literature 1 has a problem that it may be impossible to insert and remove the insertion connectors altogether depending on the postures of the reception connectors and the number thereof.

The present invention has been achieved in view of the above problems, and an object of the invention is to provide a connector cover that can insert and remove a plurality of insertion connectors altogether regardless of the postures of the reception connectors and the number thereof.

Solution to Problem

In order to solve the aforementioned problems, a connector cover that holds altogether a plurality of insertion connectors, the insertion connectors being provided at corresponding ends of cables and inserted into reception connectors according to one aspect of the present invention is constructed in such a manner as to include: a cover part in which a plurality of holding openings that hold the insertion connectors with ends thereof being exposed are formed so that the insertion connectors can be inserted into the reception connectors, wherein the cover part can be divided along a dividing surface including the holding openings, and in the cover part, a lock-lever pressing part that presses a lock lever of corresponding one of the insertion connectors held by the holding openings to fix the insertion connectors in an unlocked state is formed for each of the holding openings.

Advantageous Effects of Invention

In the connector cover according to the present invention, a lock-lever pressing part that presses the lock lever of corresponding one of the insertion connectors is formed for each of the holding openings. Therefore, if the lock-lever pressing parts are formed in accordance with the postures of the insertion connectors, the insertion connectors can be inserted and removed altogether regardless of the postures of the reception connectors and the number thereof.

DESCRIPTION OF EMBODIMENTS

Exemplary embodiments of a connector cover and a connector connecting apparatus according to the present invention will be explained below in detail with reference to the accompanying drawings. The present invention is not limited to the embodiments.

First Embodiment

Figure 1:
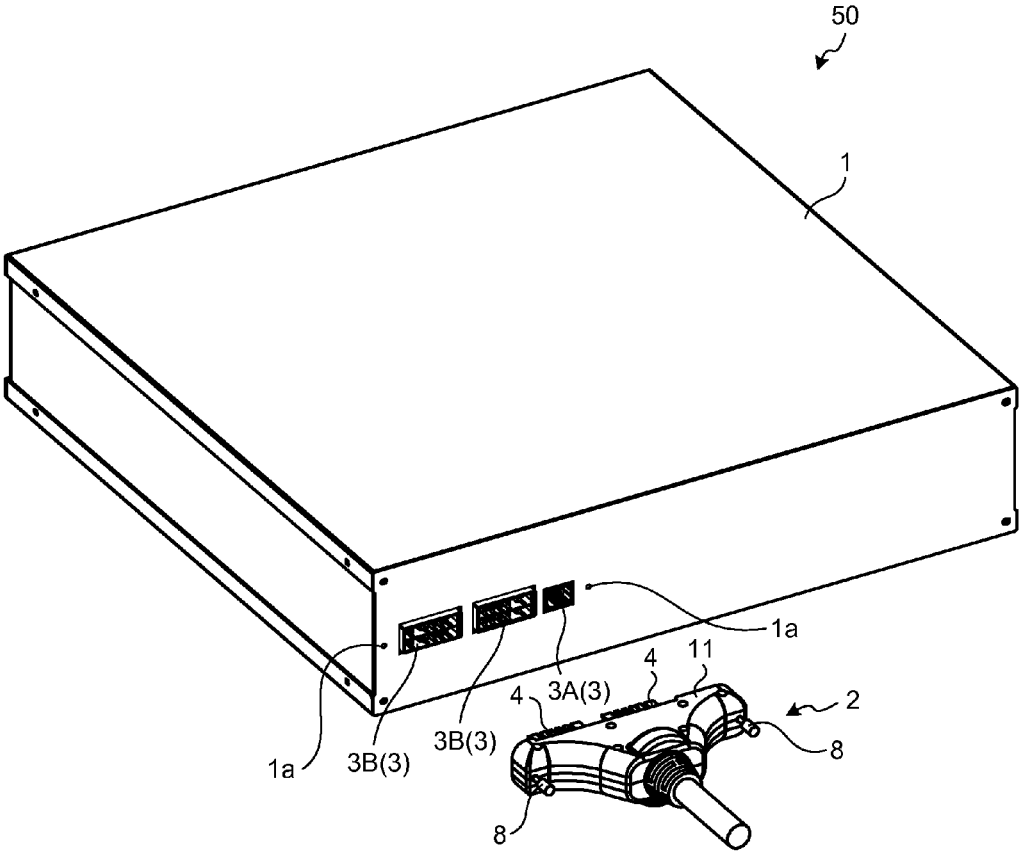
FIG. 1 is an external perspective view of a schematic configuration of a control device serving as a connector connecting apparatus according to a first embodiment of the present invention.

FIG. 1 is an external perspective view of a schematic configuration of a control device serving as a connector connecting apparatus according to a first embodiment of the present invention. For example, a control device 50 serving as a connector connecting apparatus is a control device that controls an industrial robot. The control device 50 includes a casing 1 and a connector cover 2.

A plurality of reception connectors 3 to which cables for controlling an industrial robot (not shown) are connected are provided on one surface of the casing 1. A plurality of cable connectors (insertion connectors) 4 to be inserted into the reception connectors 3 are held altogether by the connector cover 2, so that the cable connectors 4 can be inserted and removed altogether.

Figure 2:
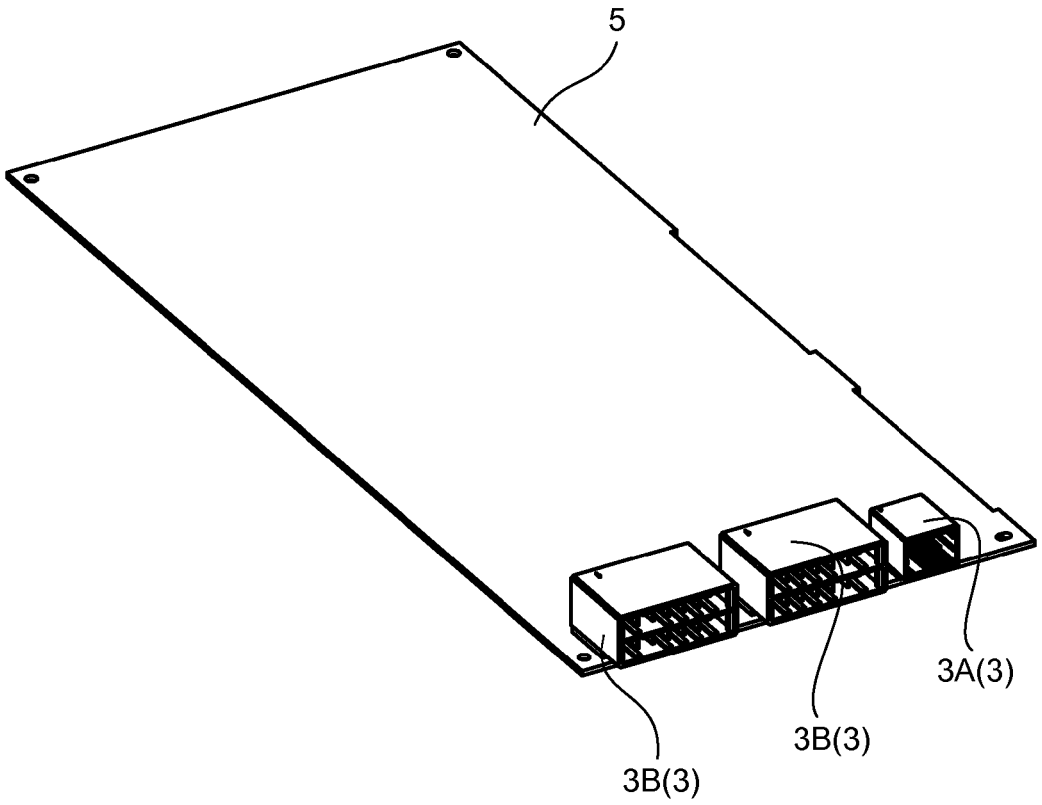
FIG. 2 is an external perspective view of a control substrate having reception connectors mounted thereon.

FIG. 2 is an external perspective view of a control substrate 5 having the reception connectors 3 mounted thereon. The control substrate 5 shown in FIG. 2 is housed in the casing 1 of the control device 50. The reception connectors 3 are mounted on the control substrate 5 in an aligned manner. As shown in FIG. 1, the reception connectors 3 mounted on the control substrate 5 are exposed to outside of the casing 1 and thus the cable connectors 4 can be inserted into the reception connectors 3. Between the control substrate 5 and the industrial robot, control signals are transmitted or received and power is supplied via the reception connectors 3 mounted on the control substrate 5 and the cable connectors 4 inserted into the reception connectors 3.

Plural types of shape of the reception connectors 3 are used according to control purposes. In the present embodiment, two types of reception connectors 3 are mounted on the control substrate 5, and one first reception connector 3A and two second reception connectors 3B larger than the first reception connector 3A are mounted thereon.

Figure 3:
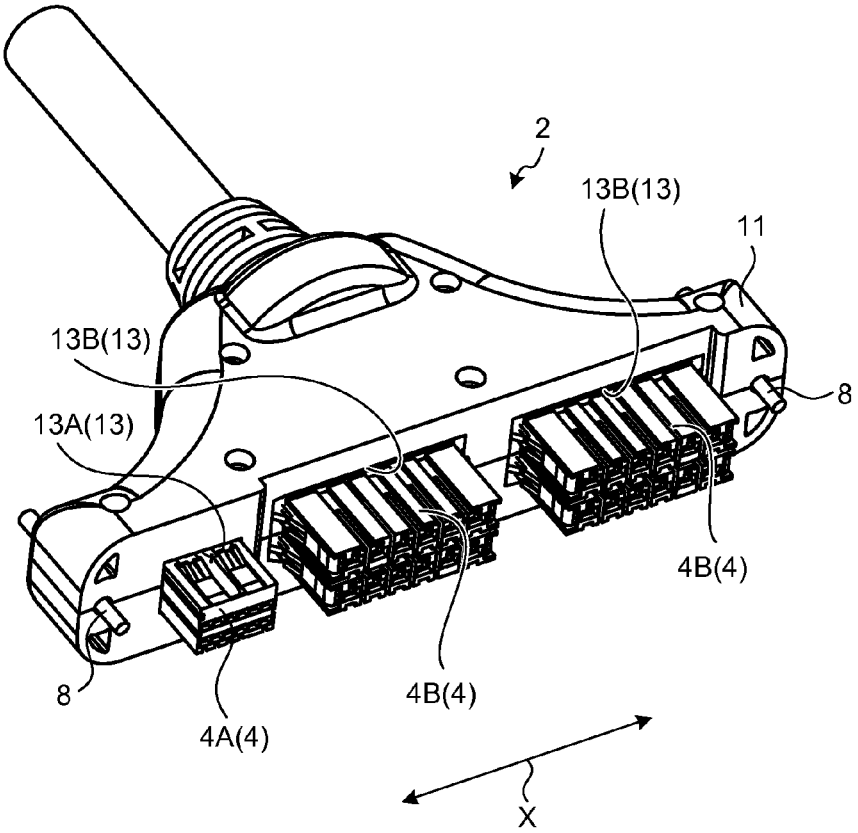
FIG. 3 is an external perspective view of a connector cover.
Figure 4:
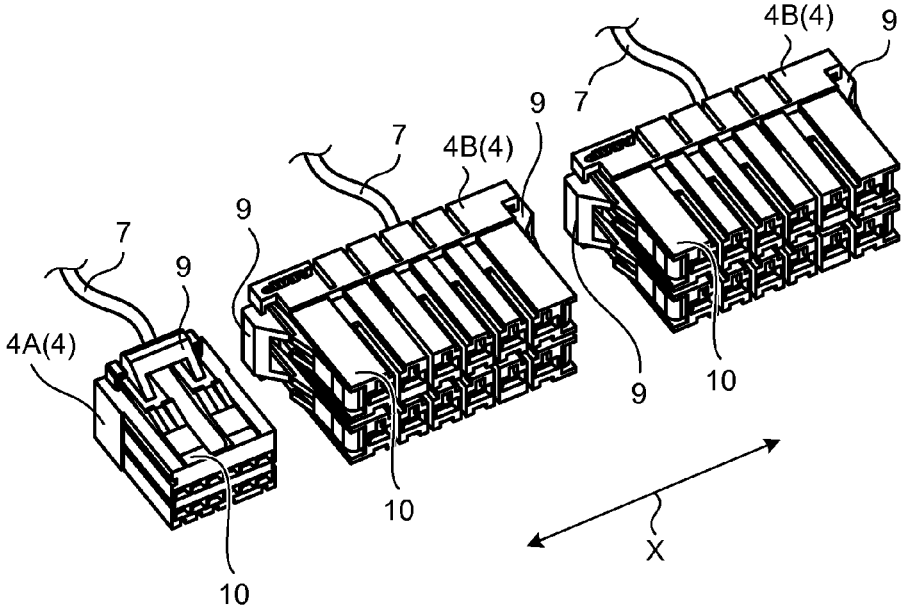
FIG. 4 shows cable connectors held by a cover part, where the cover part is omitted.

FIG. 3 is an external perspective view of the connector cover 2. The connector cover 2 includes a cover part 11, and the cable connectors 4 are held by the cover part 11 altogether. FIG. 4 shows the cable connectors 4 held by the cover part 11, where the cover part 11 is omitted.

As shown in FIGS. 3 and 4, plural types of shape of the cable connectors 4 are used according to the types of the reception connectors 3 mounted on the control substrate 5. In the present embodiment, a first cable connector 4A inserted into the first reception connector 3A and second cable connectors 4B inserted into the second reception connectors 3B, respectively, are provided. Each of the cable connectors 4 is provided at corresponding one end of cables 7. The industrial robot is connected to the other end of the cables 7.

Each of the cable connectors 4 includes one or plural lock levers 9 that restrict removal of the cable connector 4 from the corresponding reception connector 3 to prevent the cable connector 4 from accidentally falling off the reception connector 3. The lock levers 9 are pressed against connector bodies 10, respectively, to obtain an unlocked state where a lock is released. By pulling out the cable connectors 4 while pressing the lock levers 9 against the connector bodies 10, the cable connectors 4 can be removed from the reception connectors 3.

The postures of the cable connectors 4 held by the connector cover 2 are determined by the postures of the reception connectors 3 mounted on the control substrate 5, respectively. Also in the present embodiment, as shown in FIGS. 3 and 4, the direction in which the lock lever 9 is mounted with respect to the connector body 10 in the first cable connector 4A is substantially vertical to an arrangement direction X of the cable connectors 4 and the direction in which the lock levers 9 are mounted with respect to the connector bodies 10 in the second cable connectors 4B are substantially parallel to the arrangement direction X.

When the directions in which the lock levers 9 are mounted with respect to the connector bodies 10 are mutually different between each of the cable connectors 4 in this way, the operating direction of the lock levers 9 for releasing the lock varies. For this reason, it is difficult to press the lock levers 9 to bring the cable connectors 4 to an unlocked state altogether, for example, using an operation unit that is provided separately.

If the lock lever 9 is provided in a direction substantially parallel to the arrangement direction X in a cable connector 4 provided at an intermediate portion with respect to the arrangement direction X (the second cable connector 4B arranged between the first cable connector 4A and the second cable connector 4B in FIG. 4), it is made further difficult to perform the unlocking operation because adjacent cable connectors 4 become obstacles.

Figure 5:
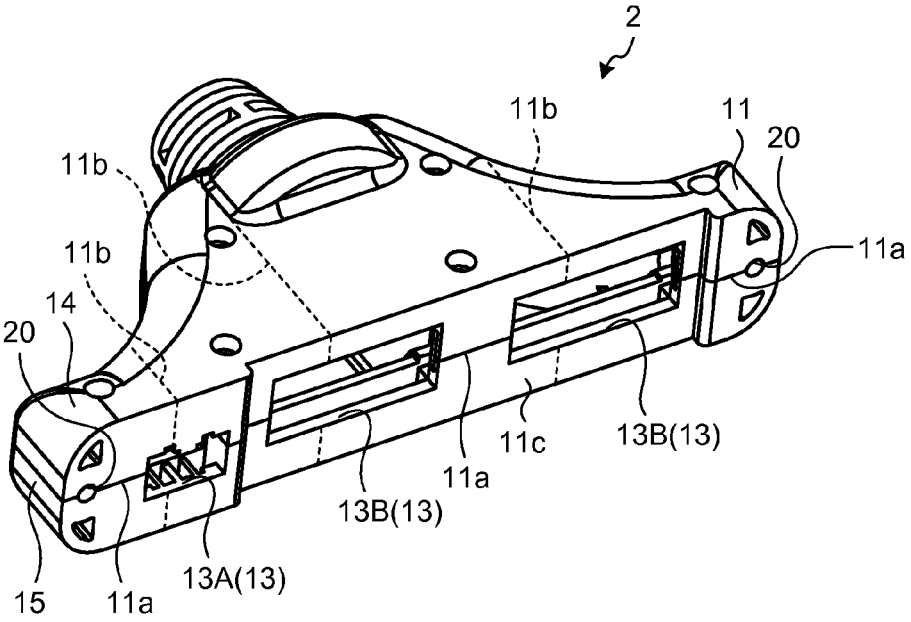
FIG. 5 is an external perspective view of a schematic configuration of the connector cover.

FIG. 5 is an external perspective view of a schematic configuration of the connector cover 2. The connector cover 2 includes the cover part 11 in which a plurality of holding openings 13 that hold the cable connectors 4 with the ends thereof being exposed are formed. The cover part 11 can be divided along a dividing surface 11*a* including a plurality of the holding openings 13. By dividing the cover part 11 along the division surface 11*a*, the cover part 11 is divided into an upper cover 14 and a lower cover 15. In the following explanations, the holding opening 13 that holds the first cable connector 4A is also referred to as "first holding opening 13A" and the holding openings 13 that hold the second cable connectors 4B are also referred to as "second holding openings 13B", respectively.

Figure 6:
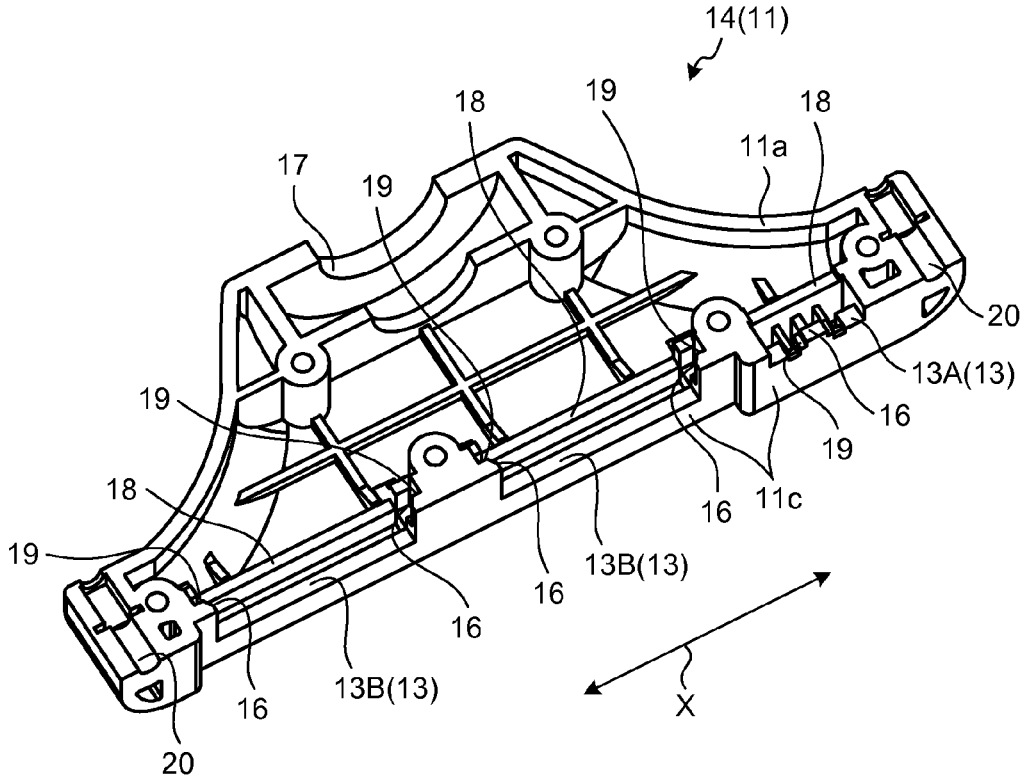
FIG. 6 is an external perspective view of an upper cover that constitutes a part of the cover part.
Figure 7:
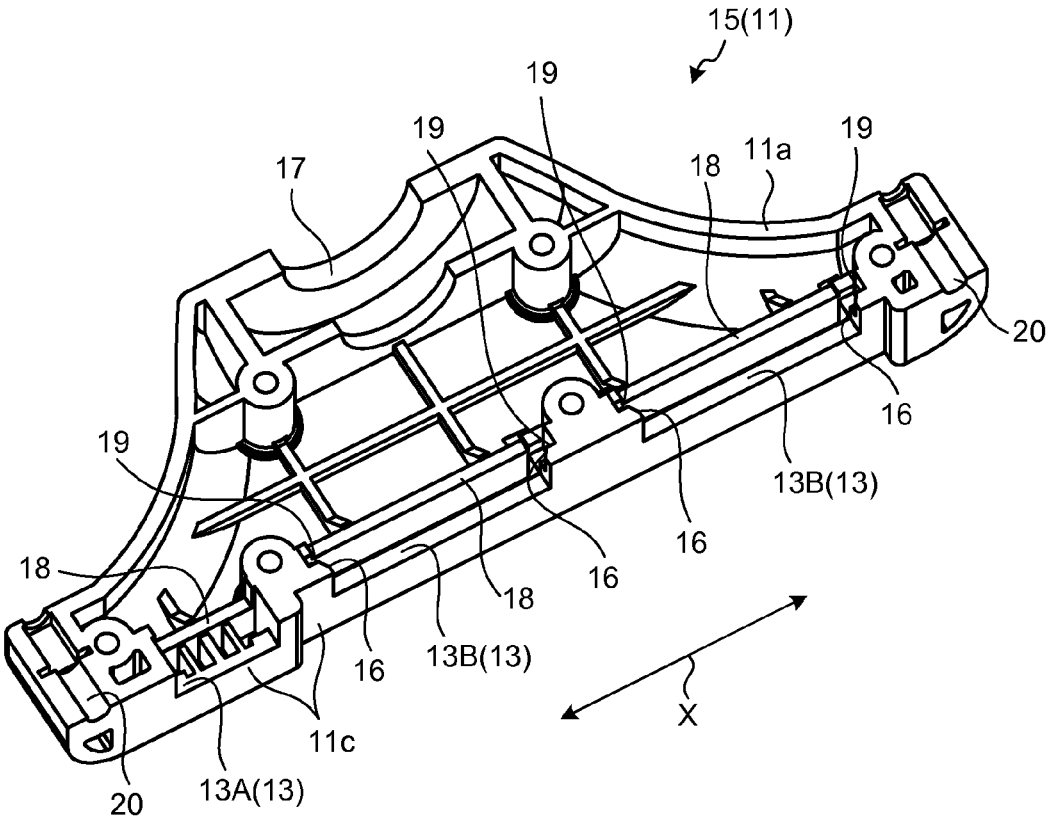
FIG. 7 is an external perspective view of a lower cover that constitutes a part of the cover part.

FIG. 6 is an external perspective view of the upper cover 14 that constitutes a part of the cover part 11. FIG. 7 is an external perspective view of the lower cover 15 that constitutes a part of the cover part 11. Spaces for housing the cable connectors 4 and the cables 7 are formed within the cover part 11. An end of each of the cable connectors 4 housed within the cover part 11 is exposed from the holding opening 13, so that the cable connector 4 can be inserted into the corresponding reception connector 3.

The holding openings 13 are formed in such a manner that the shapes thereof are substantially the same as those of the corresponding held cable connectors 4, respectively, as viewed from the side of the insertion direction. Therefore, when the cable connectors 4 are fitted into the holding openings 13, the cable connectors 4 can be securely held. Positions where the holding openings 13 are formed correspond to the arrangement positions of the reception connectors 3 mounted on the control substrate 5. Therefore, when the cable connectors 4 are held by the cover part 11, the cable connectors 4 can be easily set to the positions where the cable connectors 4 can be inserted into and removed from the reception connectors 3 altogether.

The cover part 11 is formed with lock-lever pressing parts 16 by which the lock levers 9 of the cable connectors 4 held by the holding openings 13 are pressed so as to fix the lock levers 9 in an unlocked state. Positions where the lock-lever pressing parts 16 are formed and the shapes thereof are set depending on the postures of the cable connectors 4 held by the holding openings 13.

For example, as also shown in FIG. 4, in the first holding opening 13A in which the first cable connector 4A that becomes an unlocked state by pressing the lock lever 9 in a direction substantially vertical to the arrangement direction X is held, each of the lock-lever pressing parts 16 is formed at a position substantially vertical to the arrangement direction X with respect to the connector body 10. The lock-lever pressing part 16 is formed in a protruding manner so that the lock lever 9 is pressed down through fitting of the first cable connector 4A into the first holding opening 13A.

In each of the second holding openings 13B in which the second cable connector 4B that becomes an unlocked state by pressing the lock lever 9 in a direction substantially parallel to the arrangement direction X is held, the lock-lever pressing parts 16 are formed at positions substantially parallel to the arrangement direction X with respect to the connector body 10. The distance between the lock-lever pressing parts 16 is set to be the width of the second cable connector 4B in a state where the lock levers 9 are pressed, and each of the second cable connectors 4B cannot be fitted into the corresponding second holding opening 13B unless the lock levers 9 are pressed.

The cover part 11 is formed with a cable opening 17 through which the cables 7 extending from the cable connectors 4 housed are passed altogether. The dividing surface of the cover part 11 also includes the cable opening 17.

In each of the holding openings 13, a push-prevention wall part 18 that prevents the corresponding cable connector 4 held by the holding opening 13 from being further pushed is formed. Accordingly, it is possible to prevent the cable connectors 4 from being pushed further into the cover part 11 at the time of inserting the connector cover 2. The push-prevention wall part 18 abuts to the corresponding connector body 10 or the corresponding lock levers 9, thereby preventing the corresponding cable connector 4 from being pushed into inside of the cover part 11.

Further, in each of the holding openings 13, fall-prevention wall parts 19 that prevent the corresponding cable connector 4 held by the holding opening 13 from being externally pulled out and falling off are formed. Therefore, at the time of pulling out the connector cover 2, it is possible to prevent the cable connectors 4 from falling off the cover part 11. Each of the fall-prevention wall parts 19 abuts to the corresponding connector body 10 or the corresponding lock lever 9, thereby preventing the cable connector 4 from falling off the cover part 11.

The push-prevention wall part 18 and each of the fall-prevention wall parts 19 also function as a positioning part that abuts to the corresponding connector body 10 or the corresponding lock lever 9, thereby positioning the corresponding cable connector 4 within the cover part 11 in the insertion direction.

An opposing surface 11*c* of the cover part 11 that opposes the casing 1 has an uneven shape. This uneven shape is formed to correspond to protrusions and recesses (offsets) of the reception connectors 3 arranged on the control substrate 5. That is, a part of the opposing surface 11*c* that opposes the reception connectors 3 largely protruded from the casing 1 is receded to prevent interference between the reception connectors 3 and the opposing surface 11*c*, so that smooth insertion and removal of the corresponding cable connectors 4 can be realized.

Fixing screws 8 for fixing the cover part 11 to the casing 1 are provided in the connector cover 2. Each of the fixing screws 8 passes through a through hole 20 formed to be substantially parallel to the insertion direction of the cable connectors 4. While detailed explanations of the configuration are omitted, each of the fixing screws 8 is configured to prevent its falling off from the through hole 20, so that it is possible to prevent the fixing screw 8 from being lost.

The fixing screws 8 are inserted into screw holes 1*a* formed in a surface of the casing 1 with the cable connectors 4 being inserted into the reception connectors 3 altogether, so that the cover part 11 can be fixed to the casing 1. The state where the cable connectors 4 are inserted into the reception connectors 3 can thus be maintained, and it is possible to prevent the cable connectors 4 from accidentally falling off the reception connectors 3.

According to the control device 50 including the connector cover 2 explained above, the cable connectors 4 can be held by the connector cover 2 altogether, and the cable connectors 4 can also be inserted and removed altogether by operating the connector cover 2.

Because the holding openings 13 formed in the connector cover 2 are included in the dividing surface 11*a*, the cable connectors 4 can be easily fitted into the holding openings 13 and held by the connector cover 2 by disassembling the cover part 11 into the upper cover 14 and the lower cover 15. Even when the cable connectors 4 are commercially available products, the cable connectors 4 can be used without machining themselves if the holding openings 13 are formed to correspond to the shape of the cable connectors 4.

When the cable connectors 4 are fitted into the holding openings 13, each of the lock levers 9 is pressed by the corresponding lock-lever pressing part 16 and is fixed in an unlocked state. Therefore, it is possible to prevent a case in which the locked state cannot be unreleased and thus the cable connectors 4 cannot be removed. Each of the lock-lever pressing parts 16 is formed with respect to the corresponding holding opening 13, and thus if the lock-lever pressing parts 16 are formed according to the postures of the corresponding cable connectors 4, respectively, the cable connectors 4 can be inserted and removed altogether regardless of the postures of the reception connectors 3 and the number thereof.

Even when the cable connectors 4 are fixed in an unlocked state, the cover part 11 can be fixed to the casing 1 by the fixing screws 8, and thus it is possible to prevent the cable connectors 4 from accidentally falling off the reception connectors 3.

Although in the present embodiment it has been explained regarding the case in which the cover part 11 divided into two pieces along the dividing surface 11*a* that is substantially parallel to the arrangement direction X as an example, the present invention is not limited thereto. For example, the cover part 11 can be divided along division surfaces 11*b* (see broken lines in FIG. 5) that are substantially vertical to the arrangement direction X. In this case, as shown in FIG. 5, the cover part 11 is configured to be divided into three pieces, so that the cable connectors 4 can be easily fitted into the holding openings 13.

Further, although in the present embodiment it has been explained regarding the case in which the cable connectors 4 are arranged in one line along the arrangement direction X, the present invention is not limited thereto. The cable connectors 4 can also be arranged in a direction substantially vertical to the arrangement direction X. For example, the cable connectors 4 can be arranged in three lines along the arrangement direction X and in two lines along a direction vertical to the arrangement direction X. In this case, by increasing the number of divisions of the cover part 11, the cable connectors 4 can be easily fitted into the holding openings 13.

INDUSTRIAL APPLICABILITY

As described above, the connector cover according to the present invention is useful as a connector cover that holds altogether a plurality of cable connectors each having one or plural lock levers.

REFERENCE SIGNS LIST

1 casing, 1*a* screw hole, 2 connector cover, 3 reception connector, 3A first reception connector, 3B second reception connector, 4 cable connector (insertion connector), 4A first cable connector, 4B second cable connector, 5 control substrate, 7 cable, 8 fixing screw, lock lever, 10 connector body, 11 cover part, 11*a*, 11*b* division surface, 11*c* opposing surface, 13 holding opening, 13A first holding opening, 13B second holding opening, 14 upper cover, 15 lower cover, 16 lock-lever pressing part, 17 cable opening, 18 push-prevention wall part, 19 fall-prevention wall part, 20 through hole, 50 control device (connector connecting apparatus).

The invention claimed is:

1. A connector cover that holds altogether a plurality of insertion connectors, the insertion connectors being provided at corresponding ends of cables and inserted into corresponding reception connectors, the connector cover comprising:

a cover part in which a plurality of holding openings that hold the insertion connectors with ends thereof being exposed are formed so that the insertion connectors can be inserted into the reception connectors, wherein the cover part can be divided along a dividing surface including the holding openings, and in the cover part, a lock-lever pressing part that presses a lock lever of corresponding one of the insertion connectors held by the holding openings to fix the insertion connectors in an unlocked state is formed for each of the holding openings;

the cover part is formed with a push-prevention wall part that abuts a corresponding one of the insertion connectors to prevent the insertion connectors from being pushed into the cover part, and a fall-prevention wall part that abuts a corresponding one of the insertion connectors to prevent the insertion connectors from being pulled outside of the cover part and falling off;

wherein the fall-prevention wall part is separate from the push-prevention wall part.

2. The connector cover according to claim 1, wherein the cover part is formed with a cable opening that communicates to the holding openings to cause the cables to pass therethrough altogether.

3. The connector cover according to claim 2, wherein the cable opening is also included in the dividing surface.

4. The connector cover according to claim 1, further comprising a fixing screw that fixes the cover part to a connector connecting apparatus in which the reception connectors are provided.

5. A connector connecting apparatus comprising:

a casing having one surface on which a plurality of reception connectors, into which insertion connectors provided at corresponding ends of cables are inserted, are provided; and a connector cover that holds altogether the insertion connectors inserted into the reception connectors at a distance between which the reception connectors are formed, wherein the connector cover includes a cover part in which a plurality of holding openings that hold the insertion connectors with ends thereof being exposed are formed so that the insertion connectors can be inserted into the reception connectors, the cover part can be divided along a dividing surface including the holding openings, and the cover part is formed with a lock-lever pressing part that presses a lock lever of corresponding one of the insertion connectors held by the holding openings to fix the insertion connectors in an unlocked state;

wherein the cover part is further formed with a push-prevention wall part that abuts a corresponding one of the insertion connectors to prevent the insertion connectors from being pushed into the cover part, and a fall-prevention wall part that abuts a corresponding one of the insertion connectors to prevent the insertion connectors from being pulled outside of the cover part and falling off; and wherein the fall-prevention wall part is separate from the push-prevention wall part.

6. The connector connecting apparatus according to claim 5, wherein a screw hole is formed in one surface of the casing, and the connector cover further includes a fixing screw that is threaded into the screw hole in a state where the insertion connectors held by the cover part are inserted into the reception connectors and that fixes the cover part to the surface of the casing.

7. The connector connecting apparatus according to claim 5, wherein a surface of the cover part in which the holding openings are formed has an uneven shape according to amount of protrusion of the reception connectors.

* * * * *